US006598318B2

(12) United States Patent
Rouben

(10) Patent No.: US 6,598,318 B2
(45) Date of Patent: Jul. 29, 2003

(54) SHOE WITH A USER-INTERCHANGEABLE SOLE

(76) Inventor: Caroline Lillian Rouben, 25 Stonedene Boulevard, North York, Ontario (CA), M2R 3C6

( * ) Notice: Subject to any disclaimer, the term of this patent is extended or adjusted under 35 U.S.C. 154(b) by 126 days.

(21) Appl. No.: 09/776,143

(22) Filed: Feb. 2, 2001

(65) Prior Publication Data

US 2002/0124435 A1 Sep. 12, 2002

Related U.S. Application Data

(60) Provisional application No. 60/182,975, filed on Feb. 16, 2000.

(51) Int. Cl.[7] ..... A43B 13/28; A43B 23/20; A43B 5/04; A43C 13/00

(52) U.S. Cl. ..... 36/15; 36/12; 36/23; 36/117.4

(58) Field of Search ..... 36/15, 101, 100, 36/117.3, 117.4, 12, 23, 24, 62, 64, 59 R, 7.1 R, 31

(56) References Cited

U.S. PATENT DOCUMENTS 4,351,120 A * 9/1982 Dalebout ..... 36/117.3
4,377,042 A * 3/1983 Bauer ..... 36/101
4,542,599 A * 9/1985 Annovi ..... 36/117.4
4,570,363 A * 2/1986 Annovi ..... 36/117.4
5,317,822 A * 6/1994 Johnson ..... 36/101
5,692,322 A * 12/1997 Lombardino ..... 36/100
5,956,870 A * 9/1999 Grossman et al. ..... 36/15
6,311,413 B1 * 11/2001 Chern et al. ..... 36/100
6,345,454 B1 * 2/2002 Cotton ..... 36/101

FOREIGN PATENT DOCUMENTS

GB 2178940 A * 2/1987 ..... A43B/13/36

* cited by examiner

*Primary Examiner*—Anthony D. Stashick
(74) *Attorney, Agent, or Firm*—Brian B. Shaw, Esq.; Roger Aceto, Esq.; Harter, Secrest & Emery LLP

(57) ABSTRACT

A shoe including an upper, a mid sole permanently attached thereto, and an outer sole releasably engaged with the mid sole. The outer sole and mid sole are secured together by a fastener and by a retaining lip. The fastener can be disposed in a capture position wherein the spaced apart lip precludes separation of the mid sole and outer sole. Upon disposing the fastener in a release position, the mid sole can be separated from the outer sole.

7 Claims, 12 Drawing Sheets

SHOE WITH A USER-INTERCHANGEABLE SOLE

The present non-provisional application claims benefit to a previously filed provisional application, which includes a common inventor, Caroline Rouben, and was assigned Ser. No. 60/182,975, filed Feb. 16, 2000.

FIELD OF THE INVENTION

The invention pertains to an article of footwear, and in particular to a user-replaceable sole therefor.

BACKGROUND OF THE INVENTION

It was at one time much more commonplace than at the present time for an article of footwear to be repaired. At a time when labor was comparatively inexpensive, a pair of shoes could be re-soled and re-heeled at a small fraction of the cost of purchasing a new pair. Typically, a pair of shoes would be repaired several times.

Traditional shoes are still made, and repaired, in large numbers. However, the cost of repair relative to that of a new pair of shoes is much higher than previously.

Although "traditional" shoes vary to some degree, they are constructed in a fairly standard manner which facilitates repair. Typically, a shoe includes an upper, a platform, a sole and a heel; other features such as a lining and an inner sole may also be present. The platform provides the main support for the bottom of the foot, and the sole and heel simply function to protect the under side of the platform from wear.

On a new shoe, the sole usually extends beneath the platform for the entire length of the shoe. Sometimes, the rear potion of the sole functions as the heel although, a separate heel is usually present beneath the rear of the sole. The heel consists of at least one layer or lift of material. The lowermost layer which contacts the ground when a wearer is upright is, unexpectedly, known as the top lift.

Traditionally, the repair of a shoe can involve adding a new layer of material such as leather or rubber to that portion of the sole which normally contacts the ground and is most subject to wear; a worn top lift can be removed and replaced by a new one. Alternatively, a new through sole can be provided, replacing the previous sole over the entire length of the shoe. In this case, all the lifts making up the heel are removed to be replaced by new ones once the new through sole has been installed.

Stylistic aspects of footwear were traditionally determined at the point of manufacture, the user's only option when selecting a different style or appearance being to select one pair of shoes in preference to another.

SUMMARY OF THE INVENTION

Present day shoes are configured with much more variation and manufactured by a greater variety of techniques than was formerly the case; frequently, they do not lend themselves to being easily repaired, and are treated as disposable.

While fashion and style has always been important in footwear, the appearance of the soles and heels is now often considered to be as important as the upper portion, both from an aesthetic point of view and for displaying a manufacturer's mark or logo. Since the soles and heels are usually the first portions of a shoe to wear out, it would be advantageous for a manufacturer to provide a convenient and inexpensive means for a user to replace them. If a manufacturer could offer replacement soles in a variety of colors or designs, the user could choose a preferred replacement. The user might even consider rotating between different replacements for fashion purposes even when little or no significant wear has taken place.

Furthermore, the user may desire to change the style or appearance of the upper part of the shoe without the expense of purchasing an entirely new pair of shoes. It would be advantageous for such a user to provide for replacing the upper while retaining the sole.

The present invention pertains to a shoe having an easily releasable and replaceable outer sole. The outer sole removably engages a mid sole or platform, which is permanently attached to the upper of the shoe.

The user can separate the outer sole from the mid sole and substitute either one by a replacement. The substituted mid sole or outer sole can be identical to or different from the original, so long as it is compatible with the remaining portion of the shoe.

It is an object of the present invention to provide for a user a readily installable replacement outer sole for an article of footwear, the original outer sole being readily removable by the user.

It is another object of the invention to provide the user with the option of substituting for the original outer sole a replacement outer sole identical to or different from the original outer sole, the particularly with a view to changing the color or aesthetic design.

It is yet another object of the invention to provide the user with the option of substituting for the original mid sole a replacement mid sole conforming with the outer sole, the replacement mid sole for example having an upper different from the original upper with respect to color and aesthetic design.

It is in particular an object of the invention to provide an article of footwear having an appearance which can be changed selectably by the user.

BRIEF DESCRIPTION OF THE DRAWINGS

FIG. 4(*a*) is a side elevation of a mid sole configured differently from the mid sole of FIG. 4.

DETAILED DESCRIPTION OF THE INVENTION

The invention includes a sole assembly 100 for a shoe 102, the assembly 100 having a mid sole 110 and a removable outer sole 130 which can be held together by reversibly securing corresponding fastening features near one end of the shoe 102. Near the opposite end of the shoe 102, the mid sole 110 and outer sole 130 have interlocking features which hold the soles in close contact, precluding any separation when the fastening features are secured, while readily permitting such separation when the fastening features are disengaged by a user.

Figure 1:
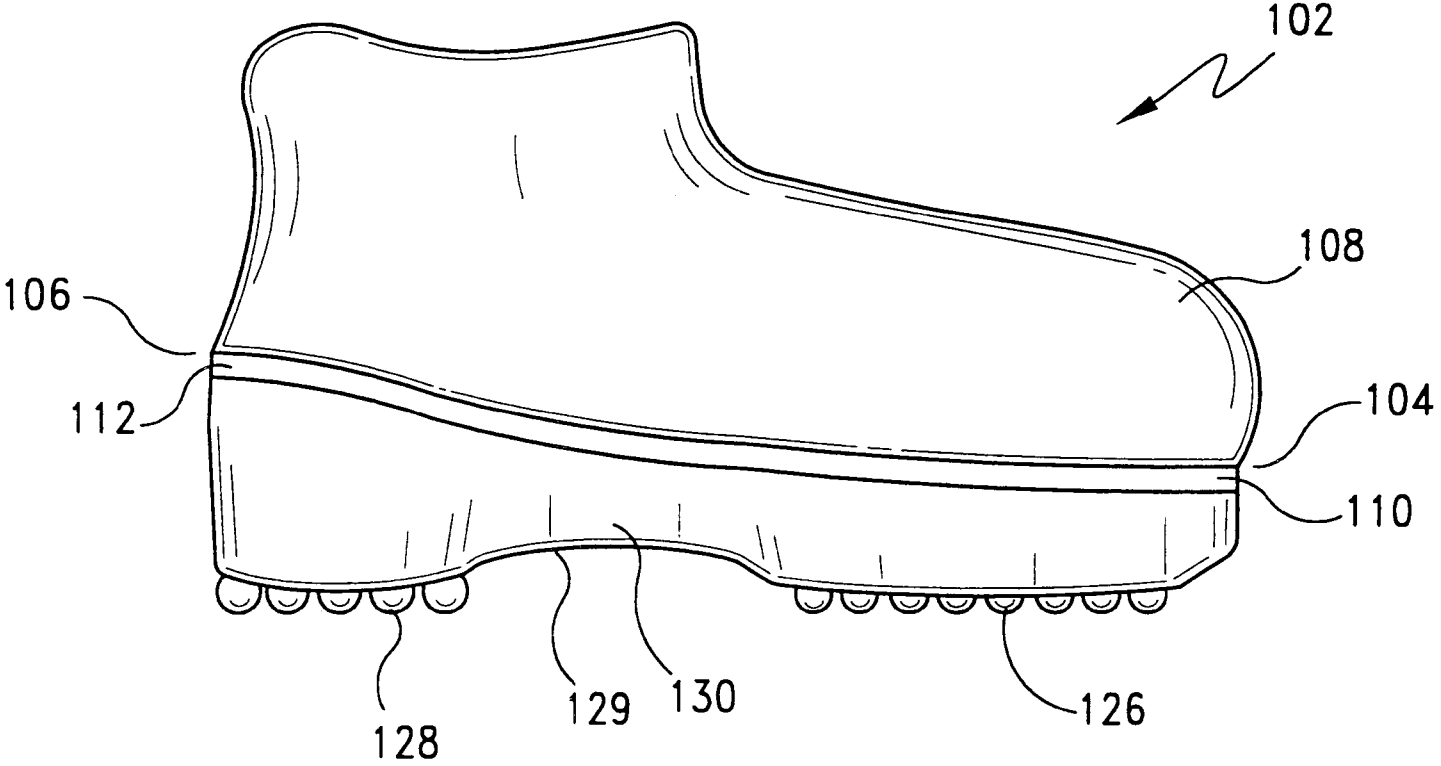
FIG. 1 is a schematic side view of a shoe.

Referring now to the drawings, FIG. 1 shows the shoe 102 with a toe end 104, a heel end 106 and an upper 108. The mid sole 110 is permanently attached to the upper 108, while the outer sole 130 is removably attached to the mid sole 110. The mid sole 110 and outer sole 130 extend generally over the entire length of the shoe 102. In description which follows, adjectives which are directional in nature such as "top", "upper", "front" and so on will always refer to the normal orientation of the shoe in everyday use. Clearly, the invention is applicable to both left and right shoes. Although some shoes are configured so that their entire bottom surface can contact the ground, it is common that they should have a distinct front ground-contacting area 126 and rear ground-contacting area 128, respectively beneath the sole and heel of the foot. The region between the front and rear ground contacting areas 126 and 128 will be referred to as an arch 129.

Figure 3:
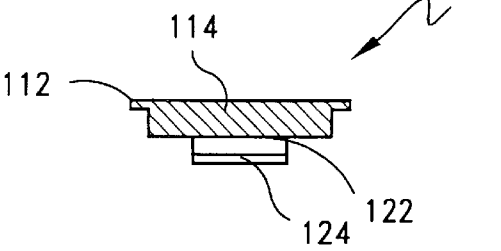
FIG. 3 is a cross-section 3—3 of the mid sole.
Figure 2:
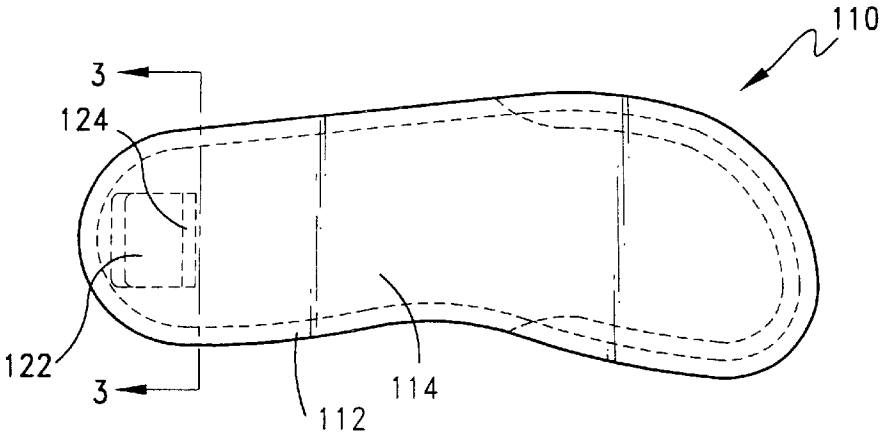
FIG. 2 is a top view of a mid sole in a first embodiment of the shoe.
Figure 4:
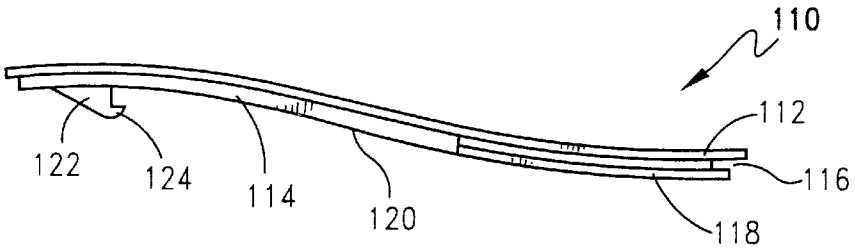
FIG. 4 is a side elevation of the mid sole.
Figure 4A:
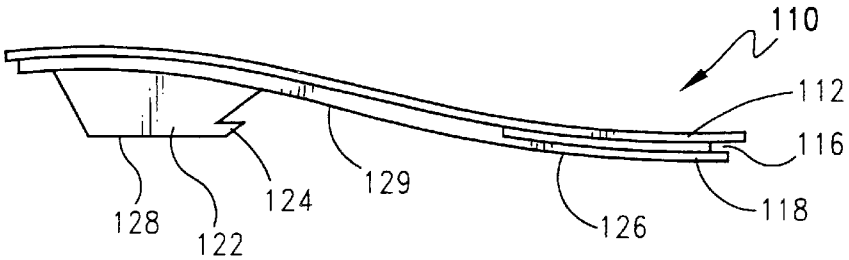

In a first embodiment the mid sole 110, best seen in FIGS. 2, 3, and 4, has a significant thickness which can typically be about 10 mm. For an uppermost part of its thickness, typically about 3 mm, the mid sole 110 has a flange or brim 112 extending a short distance (about 4 mm) outside a main portion 114. Immediately below the brim 112 is a recess 116 extending from the toe end 104 along each side of the mid sole 110 to a point approximately one-third of the way towards the heel end 106 end, thus providing a tongue 118 similar in thickness to the brim 112. The recess 116 has an effectively rectangular profile. It provides for front portions of the outer sole 130 and the mid sole 110 to engage in a manner which will be described further.

Toward the rear of a lower surface 120, the mid sole 110 has a downwardly protruding catch 122. The catch 122 has a forwardly projecting hooked portion 124, which is intended to engage a corresponding latch 180 of the outer sole 130, as will be described later. Optionally, however, the mid sole 110 could be configured so that it could be directly walked upon, without the necessity of always adding the outer sole 130. In this configuration, shown in FIG. 4(*a*), the catch 122 could be generally shaped like a traditional heel, while still having the hooked portion 124 projecting forwardly beneath the arch 129.

Figure 5:
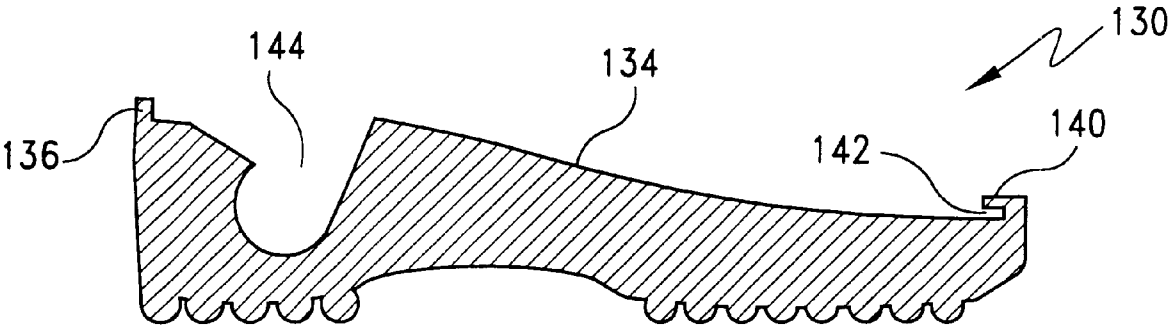
FIG. 5 is a side elevational, cross-sectional view of an outer sole of the shoe.

The outer sole 130 can be configured in a variety of shapes and thicknesses as determined by the desired appearance of the shoe 102. The example shown in FIG. 5 is structured to conform with the mid sole 110 of FIGS. 2, 3 and 4. Typically, it is significantly thicker than the mid sole 110, its thickness often being greater at the heel end 106 than the toe end 104 in order to raise the wearer's heel.

The outer sole 130 has an upper surface 134 configured to conform with the lower surface 120 of the mid sole 110. Around the outer sole 130 is an upwardly projecting wall 136 with an inner surface 138 within which the main portion 114 of the mid sole 110 can nest. Around the rearmost two-thirds or so of the outer sole, the wall 136 has a thickness which matches the distance by which the brim 112 extends beyond the body portion of the mid sole 110. Around approximately the front one-third of the outer sole 130 the wall 136 has an inwardly projecting retaining lip 140, thus forming a groove 142 closely sized and shaped to accept the tongue 118 of the mid sole 110.

Figure 6:
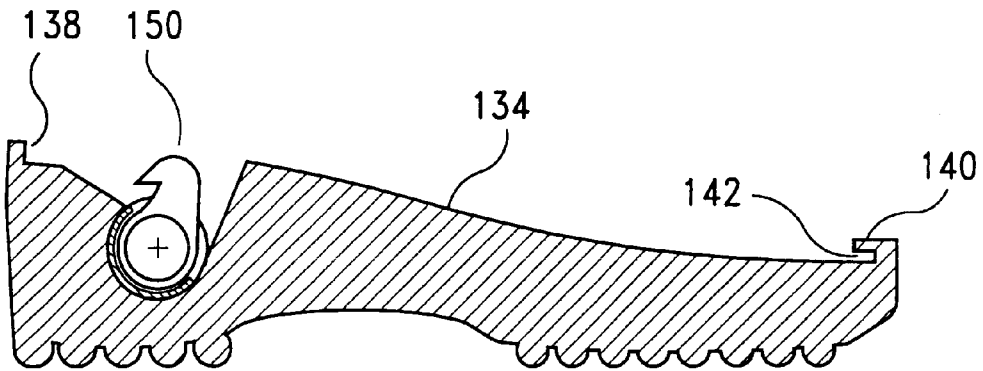
FIG. 6 is a side elevational cross-sectional view of the outer sole of FIG. 5, showing additionally a locking mechanism.
Figure 7:
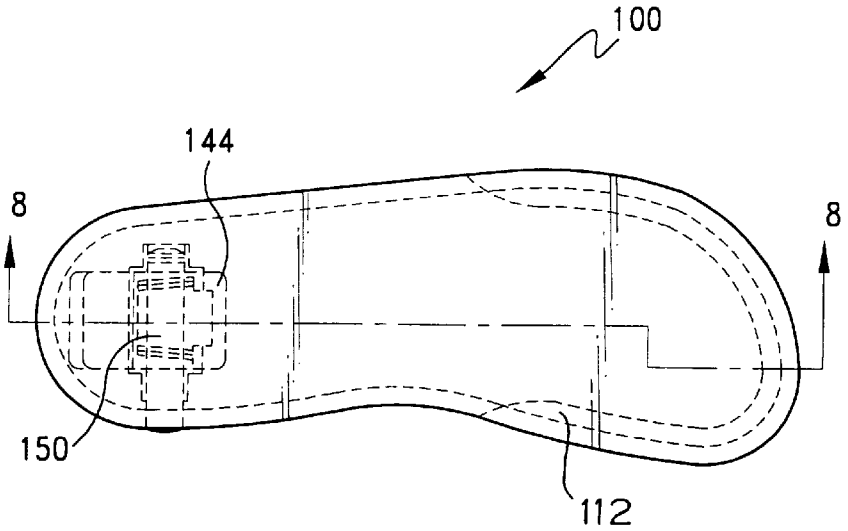
FIG. 7 is a top plan view of a sole assembly, wherein the mid sole is engaged with the outer sole.
Figure 8:
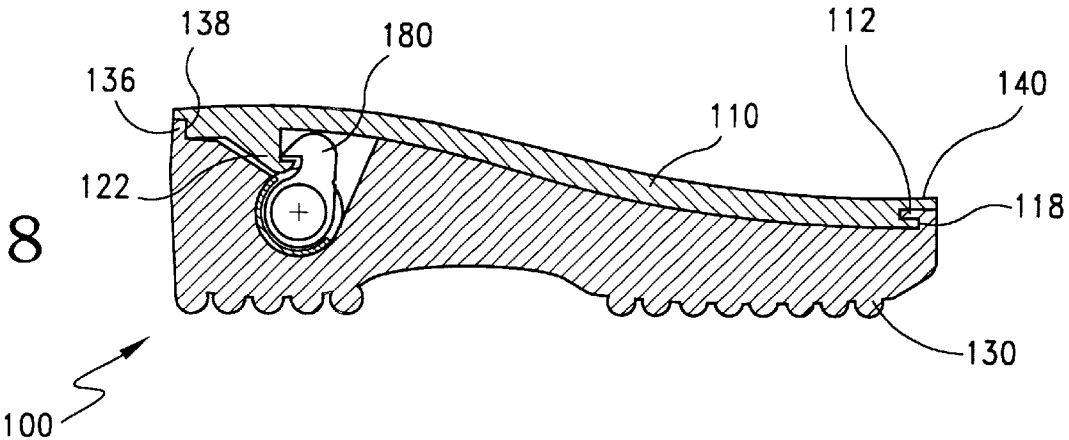
FIG. 8 is a cross-sectional view taken along lines 8—8 of FIG. 7.

Towards the rear of the outer sole 130 is a cavity 144 in which is embedded a locking mechanism 150, as seen in FIG. 6. FIGS. 7 and 8 show the mid sole 110 and the outer sole 130 when engaged together.

Figure 10:
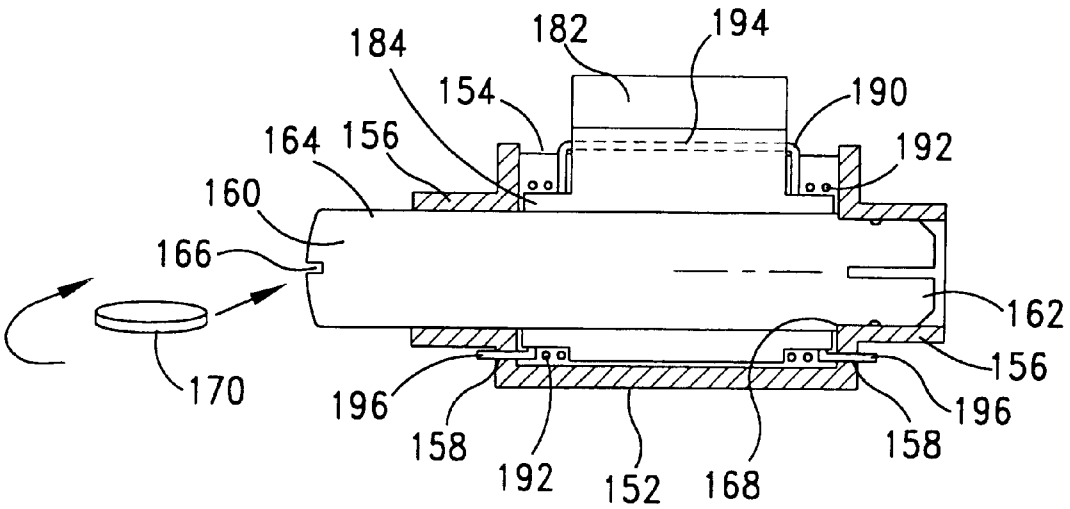
FIG. 10 is a cross sectional view taken along lines 10—10 of FIG. 9.
Figure 9:
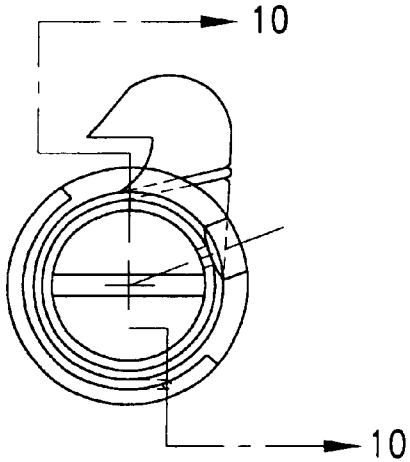
FIG. 9 is a side view of the locking mechanism.

FIGS. 9 and 10 show the locking mechanism 150. This includes a generally cylindrical casing 152 which has a generally rectangular, lateral opening 154, transversely opposed bearing ends 156, and a spindle 160 with a first end 162 and a second end 164 each passing through one of the bearing ends 156 and rotatably mounted therein.

Figure 14:
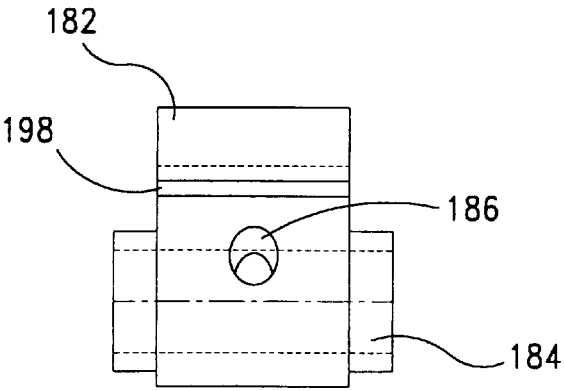
FIG. 14 is a front view of the latch.
Figure 13:
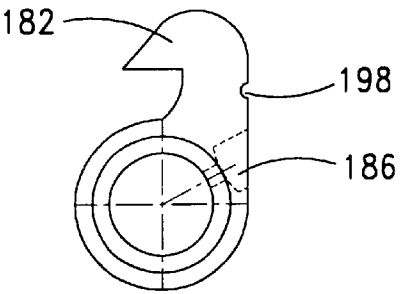
FIG. 13 is a side view of a latch of the locking mechanism.

As best seen in FIGS. 13 and 14, the latch 180 has a hook 182 and a tubular portion 184, the latter being mounted on the spindle 160 between the bearing ends 156, using a set screw (not shown) which passes through a threaded hole 186 in the tubular portion 184 and is tightened against the spindle 160. The width of the tubular portion 184 is such that it is confined by the bearing ends 156 while retaining sufficient clearance to be rotatable along with the spindle 160. The hook 182 projects through the lateral opening and is configured to project rearward so that it can engage the catch 122. As best shown in FIG. 10, the spindle 160 has a shoulder 168 abutting one of the bearing ends 156 in order to establish its proper location. Accordingly, the bearing ends 156 have different diameter openings corresponding to different diameters of the spindle 160.

Figure 12:
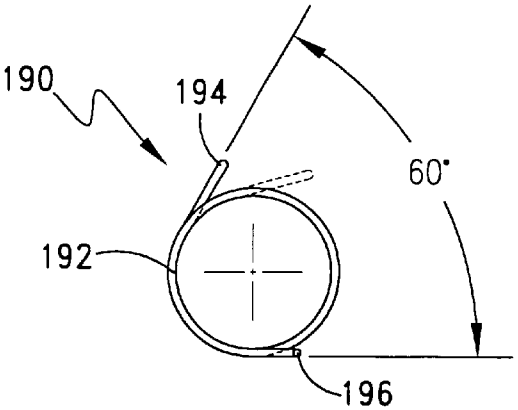
FIG. 12 is a side view of the spring.
Figure 11:
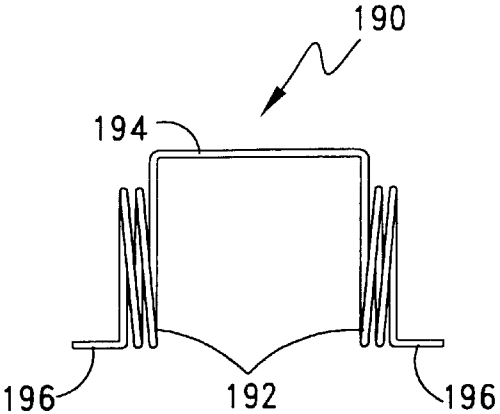
FIG. 11 is a rear view of a spring for the locking mechanism.

The locking mechanism 150 includes a bias means which holds the mechanism 150 in a capture position but allows its movement to a release position. The preferred bias means is a wire spring 190 shown in FIGS. 11 and 12, which can hold the hook 182 against the catch 122 when required. The user can rotate the spindle 160 sufficiently to disengage the hook 182 and catch 122, only a small angular turn being necessary for doing so. The spring 190 has two opposed coiled portions 192 and a cross-portion 194. Each coiled portion 192 is sized to accept the tubular portion 184, and has an outwardly projecting end portion 196 which passes through a corresponding anchoring hole 158 in the casing 152.

The latch 180 has a notch 198 for accepting the cross-portion 194 of the spring 190, which is configured so that it urges the hook 182 rearward. When not engaging the catch 122, the hook 182 has its rearward travel limited by the rear boundary of the lateral opening 154, which acts as a stop for the latch 180.

Figure 25:
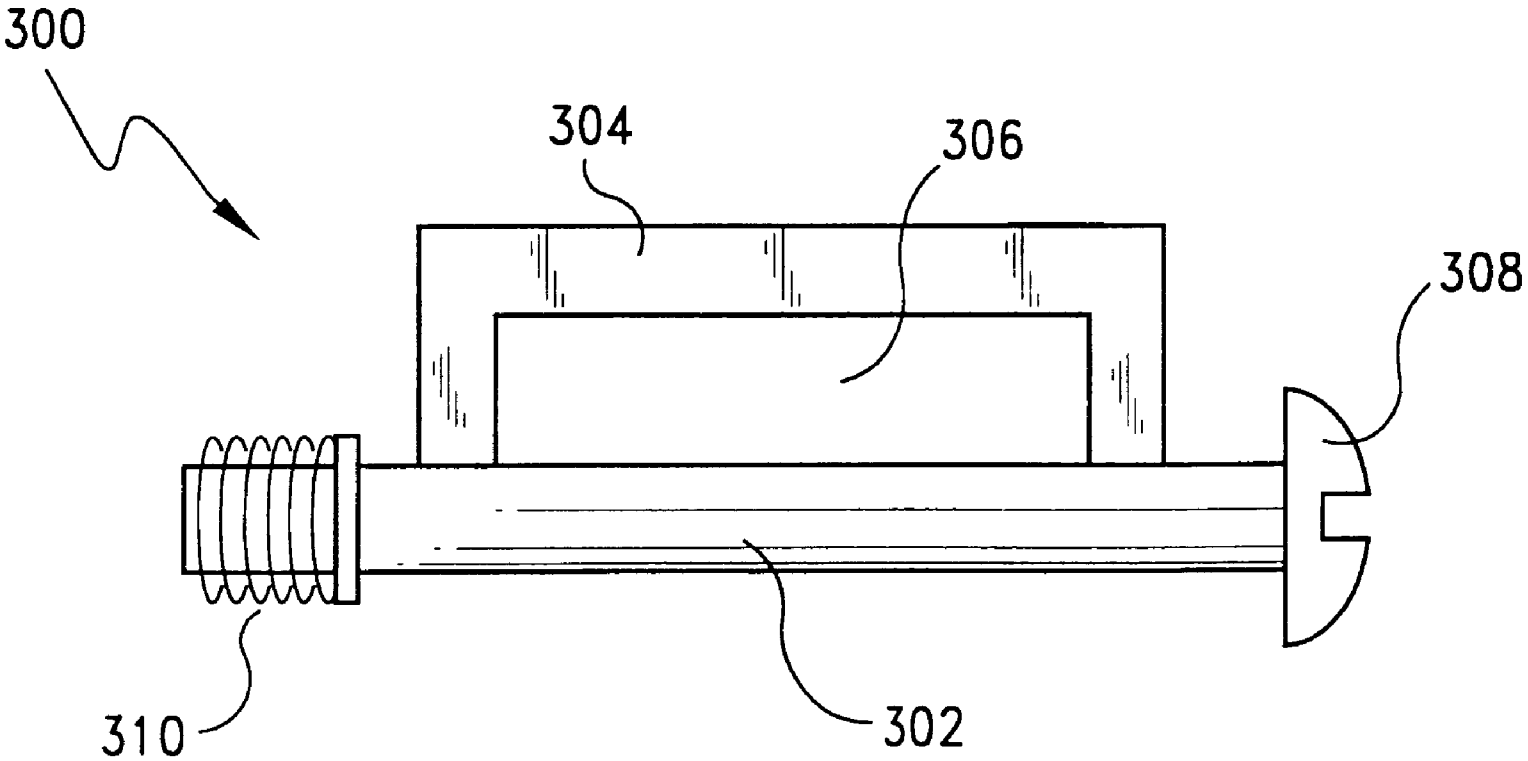
FIG. 25 is a schematic front view of a bolt fastener for the first embodiment.

In another means of locking the outer sole 130 and the mid sole 110 together, a bolt-fastener 300 is substituted into the cavity 144 for the locking mechanism 150, in a generally similar orientation thereto. The bolt-fastener 300, shown in FIG. 25, has an elongate bolt portion 302, along one side of which is fixedly mounted a flat and generally rectangular U-shaped bracket 304 to provide an aperture 306 which is intended to accept the hooked portion 124 of the catch 122. The bolt-fastener 300 has a slotted head 308 at one end. At the opposite end is attached a bias mechanism such as a coil spring 310. The cavity 144 is configured so that the bolt fastener 300 can be translated from a first axial position to a second axial position. In particular, the cavity 144 has a slit (not shown) which accepts the bracket 304 when the bolt fastener 300 is in the first axial position, and precludes its rotation; the bolt fastener 300 is thus held in a first rotational position. When the bolt fastener 300 is translated to the second axial position against the resistance of the coil spring 310, the bracket 304 is entirely disengaged from the slit, and the bolt fastener 300 can then be rotated to a second rotational position. In the first rotational position, the bracket is oriented so that is engages the hooked portion 124 of the catch 122 when the mid sole and the outer sole are attached together. The hooked portion is sized relative to the aperture 306 to permit the bolt fastener 300 to be moved between its first and second axial positions.

For aesthetic reasons, the cavity 144 in the outer sole 130 is constructed so that no part of the locking mechanism 150 is visible from the outside of the shoe 102. In this context, "outside" refers to the right side of a right shoe and the left side of a left shoe, the term "inside" being defined in like manner. The first end 162 of the spindle 160 does not project outside the casing 152, lies towards the outside of the shoe 102 and is enclosed therein. The second end 164 is directed towards the inside of the shoe 102 and projects beyond the casing 152. It is readily accessible to the user and has a slot 166 configured so that for example a coin 170 can be inserted thereinto in the same manner that a screw would engage a screwdriver, enabling the user to actuate the spindle 160.

The mid sole 110 and the outer sole 130 may be constructed differently from the foregoing description, provided however that they are configured so that the tongue 118 and lip 140 can releasably engage, while being precluded from separating when the hook 182 and catch 122 are engaged. For example, the mid sole 110 and outer sole 130 may be constructed so that the mid sole 110 is completely recessed in the outer sole 130.

Figure 16:
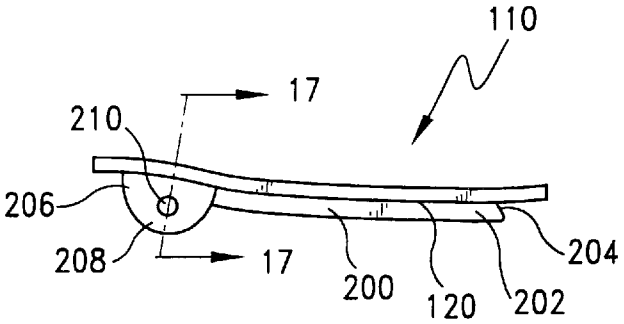
FIG. 16 is a schematic side view of the mid sole in a second embodiment of the invention.
Figure 18:
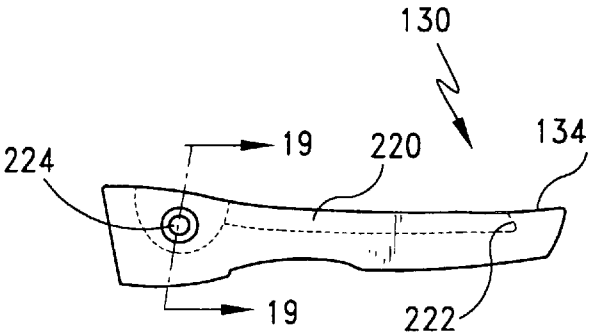
FIG. 18 is a schematic side view of the outer sole in the second embodiment.

In a second embodiment of the invention, shown in FIGS. 16, 17, 18, and 19, the mid sole 110 has a downwardly protruding longitudinal rib 200 starting some distance behind the front end, extending along a notional longitudinal center line and terminating some distance short of the back end. The total length of the rib can be about three-quarters of the length. Its width is typically about 10 mm, but other widths may be selected. The front end of the rib 202 has a first angular recess 204 as best shown in FIG. 16. Near the back end of the rib 206 is a downward extension 208 having a generally rounded profile. Near the center of the downward extension 208 is a fastening hole 210.

Figure 20:
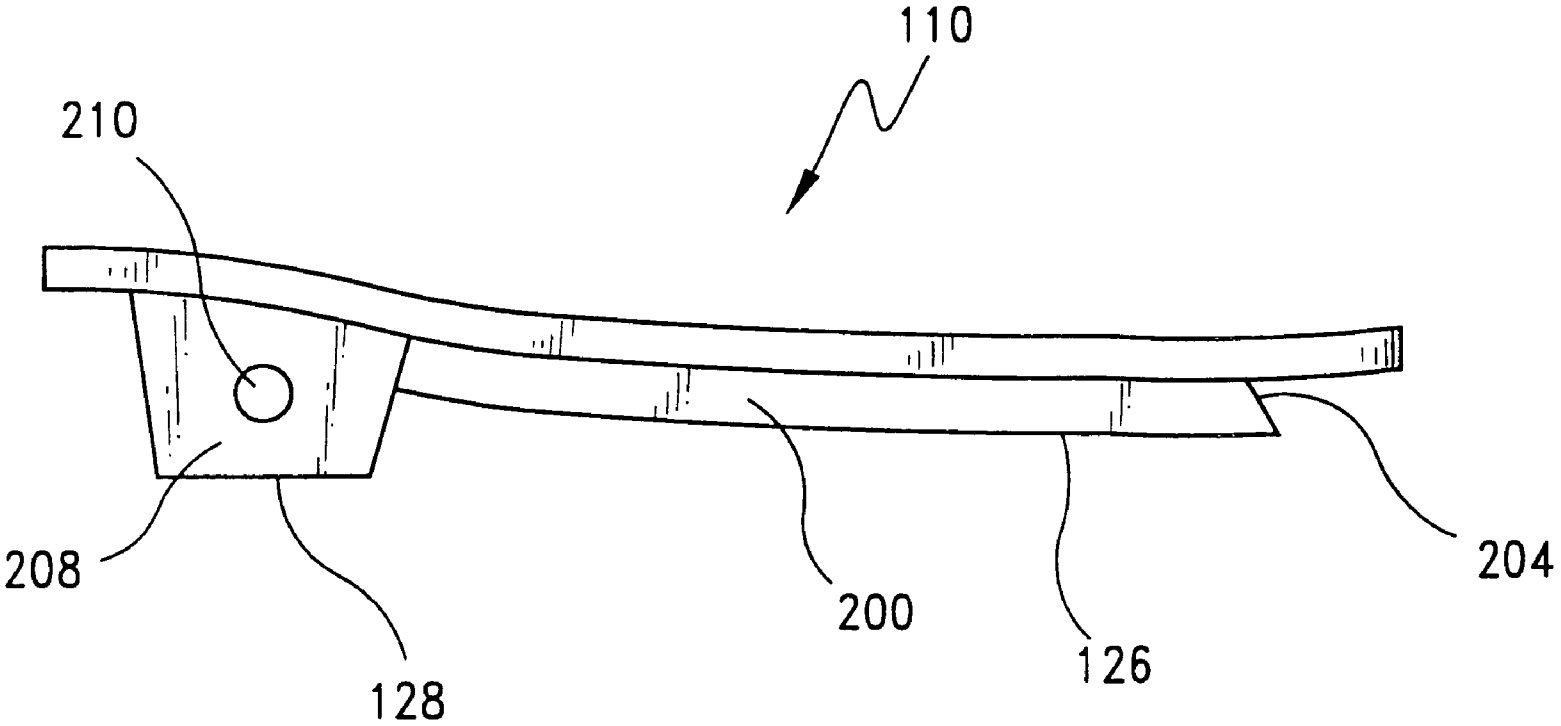
FIG. 20 is a side elevation of a mid sole of the second embodiment configured differently from the mid sole of FIG. 16.

The outer sole 130 has a longitudinal channel 220 which can accept the rib 206 and closely conforms therewith. At the front end of the channel 220 is a second angular recess 222, best seen in FIG. 18, matching the first angular recess 204. Opposed fastener holes 224 pass through the outer sole 130 in alignment with the intended position of the fastening hole 210. The outer sole 130 and the mid sole 110 can engage at the angular recesses 204 and 222, after which the fastener hole 210 and fastening holes 224 can be aligned and a fastening screw 230 passed therethrough to be secured with a nut 232. The outer sole 130 and the mid sole 110 are now interlocked at the angular recesses 204 and 222, which cooperate in manner analogous to that provided by the tongue 118 and lip 140 of the first embodiment. In other words, securing the outer sole 130 and the mid sole 110 with the fastening screw 230 also precludes there separation at the angular recesses 204 and 222. Preferably recesses are provided to accept the head of the screw 230 and the nut 232, and these may optionally be covered with decorative caps or plugs. As in the first embodiment, the mid sole could optionally be designed to be walked upon. In this configuration, shown in FIG. 20, the downward extension 208 could be generally shaped like a traditional heel, while still having the fastening hole 210 located therein. The outer sole 130 would be correspondingly configured. In this case, the width of the rib 200 would preferably be great enough to provide the user with stability in standing or walking.

Figure 21:
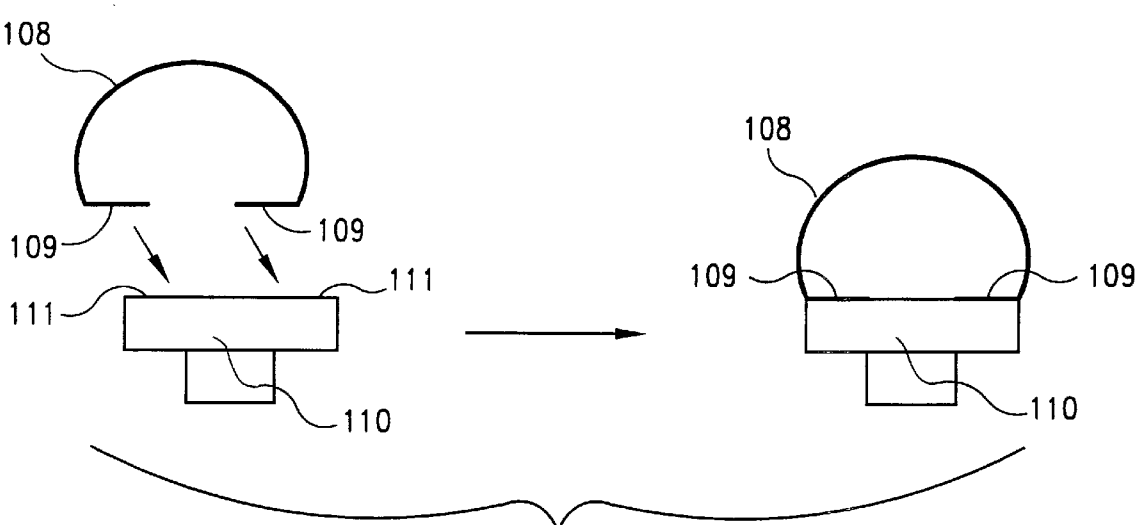
FIG. 21 shows a schematic front view of the mid sole and an upper and a mode of attachment between them.
Figure 23:
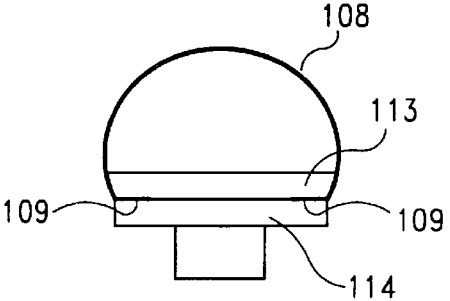
FIGS. 22 and 23 show further modes of attachment of the upper and the mid sole.
Figure 22:
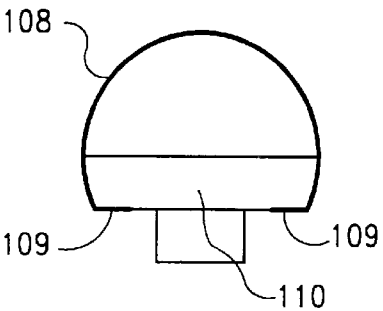

In any embodiment, the upper 108 and the mid sole 110 could be attached in a variety of ways. For example, they could be stitched, stapled or glued together at an attachment surface 111 of the mid sole 110 and an attachment portion 109 of the upper 108. The attachment portion 109 could be placed at the top of the mid sole 110, as in FIG. 21, the bottom of the mid sole 110, as in FIG. 22, or in its interior as in FIG. 23. For example, the attachment surface 111 would be in the interior if the mid sole 110 were formed as a laminate of an upper layer 113 and a lower layer 114, the attachment portion 109 of the upper 108 being sandwiched between the layers 113 and 114.

The invention can be fabricated from a variety of materials. The mid sole 110 and outer sole 130 could be of a resilient molded rubber or plastic. The upper 108 could be made from a flexible rubber, plastic, fabric or leather. In the first embodiment, most components of the locking mechanism 150 would typically be made from a hard plastic, although other materials such as metal could be employed. The spring 190 would typically be made from a spring steel. In the second embodiment, the screw 230 and nut 232 are typically made from a hard plastic although other materials such as metal are possible.

Assuming that no outer sole 130 is already present, the first embodiment of the invention is used in the following manner. The user aligns the outer sole 130 with its corresponding mid sole 110, bringing the front ends into close proximity while avoiding bringing the back ends too closely together.

Figure 15:
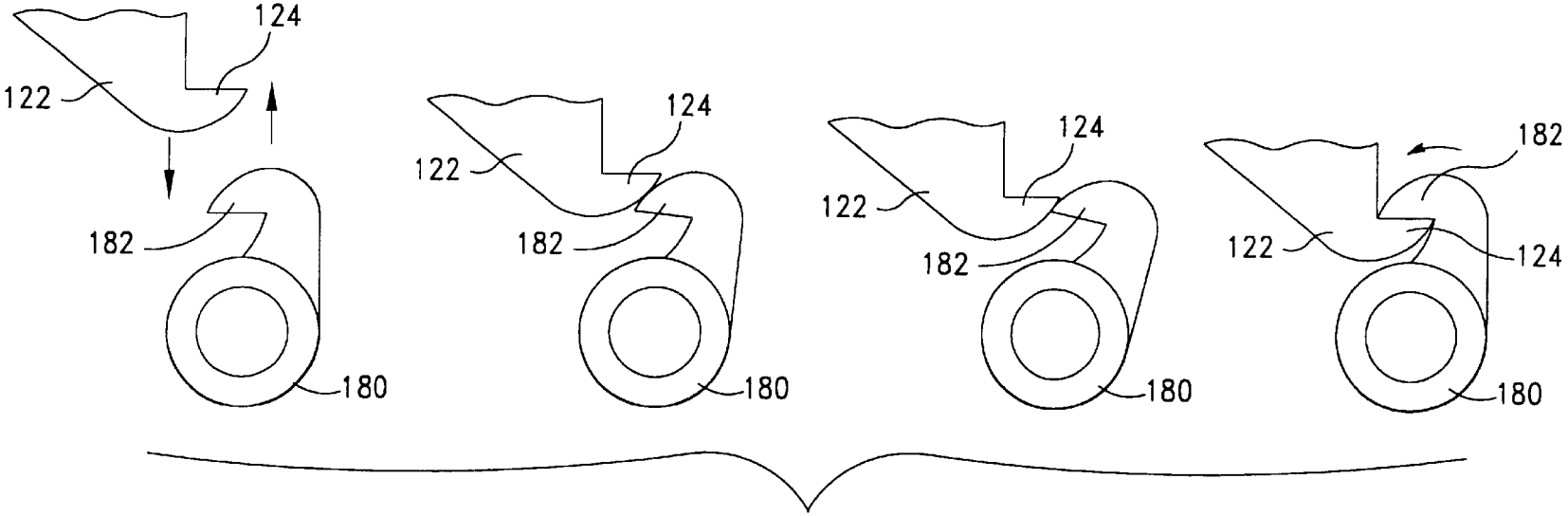
FIG. 15 is a schematic side view showing successive stages in engaging the latch and a catch.
Figure 17:
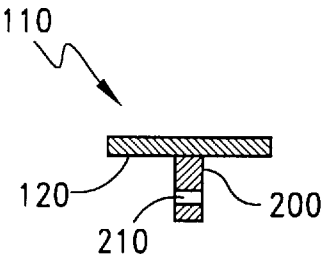
FIG. 17 is a cross-sectional view taken along lines 17—17 of FIG. 16.
Figure 19:
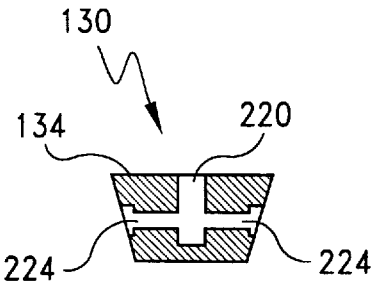
FIG. 19 is a cross-sectional view taken along lines 19—19 of FIG. 18.

At this point the outer sole 130 is slightly to the rear of its intended final position, and the user brings the outer sole 130 forward so that the tongue 118 engages the groove 142 of the mid sole 110; with equal validity, it may be considered that the flange 112 and the retaining lip 140 are cooperatively engaged. The user then brings together the back ends of the outer sole 130 and mid sole 110. The catch 122 enters the cavity 144 and contacts the hook 182. Successive stages in engaging the catch 122 and the hook 182 are illustrated in FIG. 15. As the catch 122 exerts increasing downward force against the hook 182, a resultant forward force on the hook 182 causes the latch 180 and spindle 160 to rotate forward against the resistance of the spring 190. Ultimately, the relative configurations of the hook 182 and catch 122 provide that the hook 182 is suddenly free to move rearward at the urging of the spring 190 and engage the catch 122. The outer sole 130 and mid sole 110 are now firmly secured together.

To separate the outer sole 130 and mid sole 110, the user engages the slot 166 with a coin or other implement and forwardly rotates the spindle in opposition to the force of the spring 190. Once the spindle 160 has been rotated for a fraction of a turn, the hook 182 is disengaged from the catch 122.

With the hook 182 and catch 122 disengaged, the user pulls apart the back ends of the outer sole 130 and mid sole 110 until the catch 122 is clear of the hook 182. The user can then release the spindle 160 and pull back on the outer sole 130 until the tongue 118 and groove 142 are disengaged.

Figure 24:
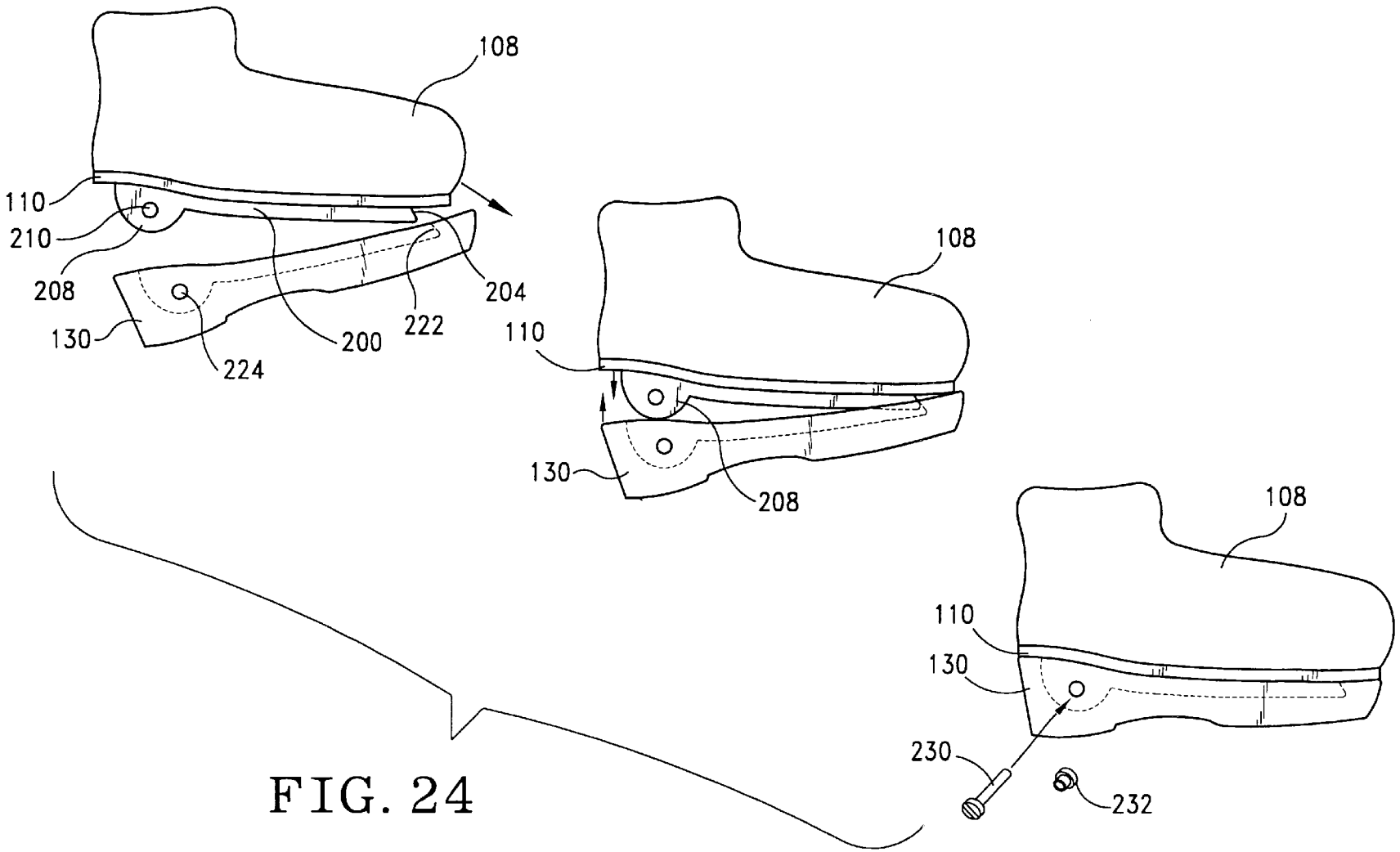
FIG. 24 is a schematic side view showing successive stages of engaging the mid sole and the outer sole in the second embodiment.

The second embodiment of the invention may be used in an analogous manner. Successive stages in the engagement of the mid sole 110 and outer sole 130 thereof are shown in FIG. 24.

This invention not only allows the manufacturer to provide a new outer sole 130 to replace one that is worn out; it also allows the manufacturer to provide the user with a variety of outer soles 130, all compatible with the same mid sole 110. The various outer soles 130 may have different colors or designs, manufacturer's logos or even licensed logos, to be interchanged as the user desires. The outer sole 130 may be transparent and contain within it colored objects which would appear magnified. It may also have internal chambers for interchangeably receiving decorative objects. Furthermore, the invention also it also allows the manufacturer to provide the user with a variety of mid soles 110, all compatible with the same outer sole 130. In such a scenario, the outer sole 130 would be comparatively durable and the various mid soles 110 would be provided with a variety of uppers 108, offering the user a choice of styles or colors. In effect, the user could "mix and match" the mid soles 110 and the outer soles 130.

The invention could be applied in other situations. For example, instead of engaging the outer sole, the mid sole could instead engage a suitably configured portion of a floor, such as in a boat or spacecraft. This would serve to keep the user steady in place. The invention could also be used in skates, skis, snowboards, and so on.

The sole assembly could include attachment points such as snaps to allow the user to attach decorative features. The mid sole and outer sole could include pockets of air or water in order to help the user feel more comfortable.

While the invention has been described in connection with the presently preferred embodiment thereof, those skilled in the art will recognize that many modifications and changes may be therein without departing from the true spirit and scope of the invention which accordingly is intended to be defined solely by the appended claims.

I claim:

1. A footwear article comprising:

(a) an upper for receiving a wearer's foot;

(b) a mid sole fixedly attached to the upper, the mid sole having a lower surface adapted for ground contact including (i) a toe portion having a lower surface adapted and intended for ground contact, the toe portion including a tongue extending from an upper peripheral edge of the toe portion, and (ii) a raised heel portion having a lower surface adapted and intended for ground contact, the heel portion including a catch;

(c) an outer sole adapted for releasable attachment to the mid sole, the outer sole having a lower surface adapted and intended for ground contact, and the outer sole including (i) a retaining lip releasably engageable with the tongue on the mid sole, and (ii) a latch carried by the outer sole spaced from the lip, the latch being movable with respect to the outer sole between a capture position engaged with the catch on the heel portion of the mid sole and a release position disengaged from the catch, and (iii) a bias mechanism carried by the outer sole and connected to the latch for urging the latch to the capture position;

(d) a release mechanism connected to the latch to selectively move the latch to the release position; and (e) the latch being engaged with the catch for attaching the outer sole to the mid sole and being selectively released and disengaged from the catch for removing the outer sole from the mid sole at the option of the wearer such that the foot wear article is selected by the wearer to be worn either with or with out the outer sole.

2. The footwear article of claim 1, where the release mechanism has a recessed surface to enable its selectable actuation.

3. The footwear article of claim 1, further comprising an axially translatable actuator connected to the release mechanism.

4. The footwear article of claim 1, where the bias mechanism is a spring.

5. The footwear article of claim 1, where the retaining lip is along a front perimeter of the outer sole.

6. The footwear article of claim 1, wherein the release mechanism is exposed to a side edge of the outer sole.

7. The footwear article of claim 6, wherein the release mechanism is rotatable and includes a slotted surface exposed at a side edge of the outer sole for selectively rotating the release mechanism to the release position.

* * * * *